United States Patent [19]

Hahlen

[11] 4,245,283

[45] Jan. 13, 1981

[54] LAMPSHADE WITH ARCUATE WALLED FLEXIBLE CONNECTING MECHANISM

[76] Inventor: Wilbur F. Hahlen, 2010 NE. 19th St., Ft. Lauderdale, Fla. 33305

[21] Appl. No.: 916,341

[22] Filed: Jun. 19, 1978

[51] Int. Cl.[3] ..... F21V 7/00

[52] U.S. Cl. ..... 362/306; 362/351; 362/360; 362/361; 24/3 M; 24/73 PC; 24/73 RM; 24/73 PM

[58] Field of Search ..... 362/306, 351, 352, 356, 362/358, 360, 361, 391, 431, 438; 24/3 M, 3 E, 73 PC, 73 RM, 73 PM, 73 PP, 134 R

[56] References Cited

U.S. PATENT DOCUMENTS

| | | | |
|---|---|---|---|
| 912,426 | 2/1909 | Sibley | 362/360 |
| 1,867,562 | 7/1932 | Burke | 362/352 |
| 2,608,644 | 8/1952 | Flint | 362/358 |
| 2,683,800 | 7/1954 | Tradelius | 362/358 |
| 3,582,643 | 6/1971 | Heise | 362/356 |
| 3,689,762 | 9/1972 | Shatan | 362/360 |
| 3,757,110 | 9/1973 | Soboleski | 362/360 |
| 3,764,801 | 10/1973 | Mainieks | 362/352 |
| 4,061,913 | 12/1977 | Ross | 362/352 |
| 4,091,815 | 5/1978 | Larsen | 24/134 R |
| 4,143,411 | 3/1979 | Roberts | 362/252 |

FOREIGN PATENT DOCUMENTS

| | | | |
|---|---|---|---|
| 924276 | 4/1973 | Canada | 362/352 |
| 31714 | 9/1964 | German Democratic Rep. | 362/352 |

*Primary Examiner*—Peter A. Nelson
*Attorney, Agent, or Firm*—Malin & Haley

[57] ABSTRACT

A lampshade for mounting on a lamp for varying the illumination intensity of the lamp which allows flexible lampshade panels to be removeably mounted in various shapes to a frame. The frame includes a plurality of rigid, vertical support members with each support having a pair of arcuate shaped rigid supports which form a concave frame recess for receiving one side edge of a panel which is inserted between adjacent frame members. In an alternate embodiment, a flexible connector having a pair of arcuate walls connected by a central wall perpendicular thereto is disposed in a slot in a rigid vertical support member which allows for flexibly tensioning panels connected thereto along their sides. In either embodiment the particular final shape of the panel between adjacent frame members may be altered depending on the distance between the support members and the size of the panel inserted therein.

3 Claims, 6 Drawing Figures

Fig. 1.
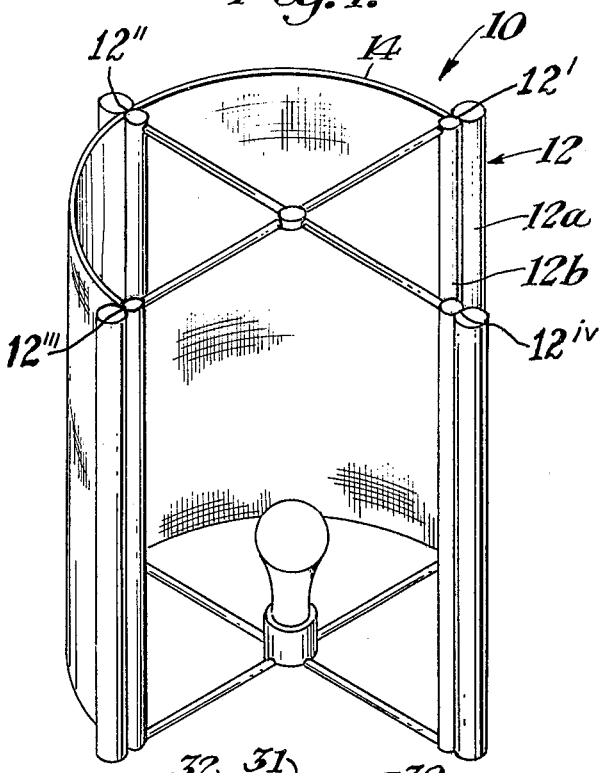
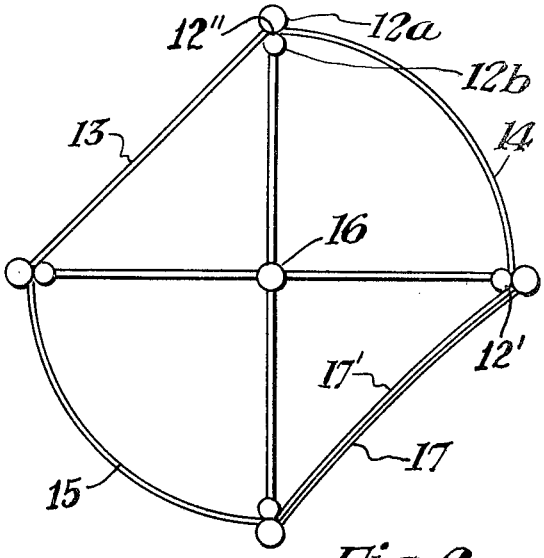
Fig. 2.
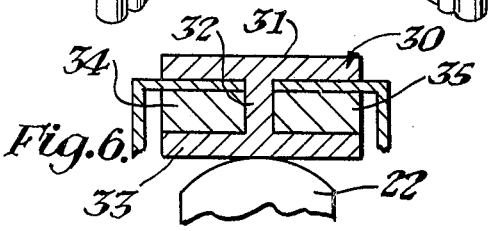
Fig. 6.
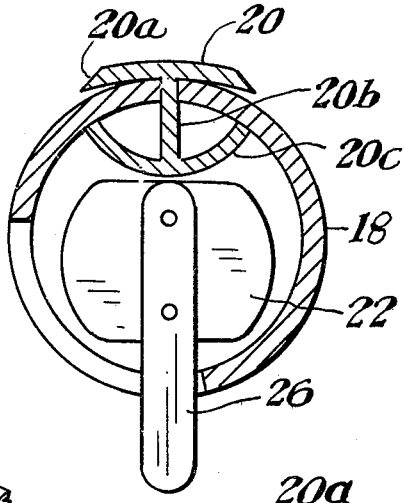
Fig. 3.
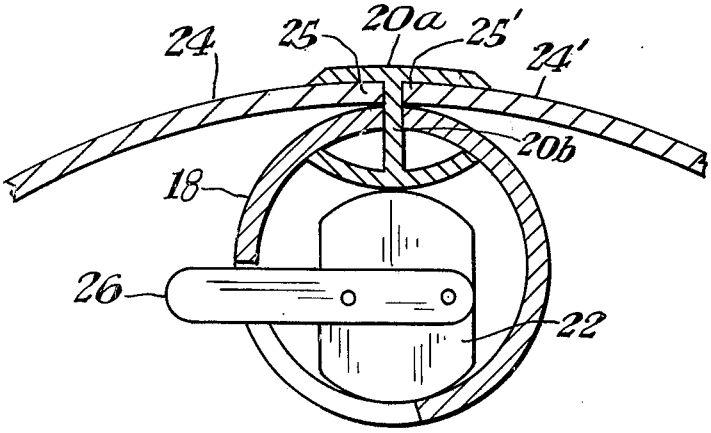
Fig. 4.
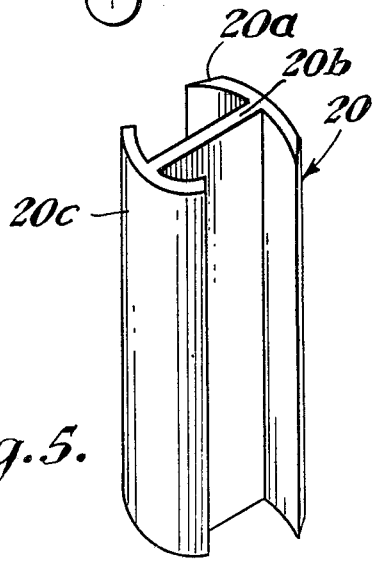
Fig. 5.

LAMPSHADE WITH ARCUATE WALLED FLEXIBLE CONNECTING MECHANISM

BACKGROUND OF THE INVENTION

The invention relates generally to lampshades which are utilized to screen or reduce the illumination effects from an electric lightbulb or the like, and specifically to a versatile lampshade which allows one to freely substitute a plurality of different panels therein formed in different shapes.

In the past, lampshades have been constructed using complex fasteners or connection devices which do not allow for mass production techniques to substantially alter the shapes or various panel inserts such that a basic frame and panel design can provide a plurality of lampshade arrays or a complete variety of ultimate lampshades. The present invention overcomes the problems found in the prior art by providing for a unique frame mounting for flexible panels which allows the panels to be deformed for a particular shape between adjacent frame members. Employing a basic single frame design, one can create an extreme variety of different types of lampshades having different peripheral shape and intensity level illumination screening.

Various types of lamps and lampshades having removeable panels are known in the prior art. One such lampshade is described in U.S. Pat. No. 3,582,643 in which a frame having vertical support members is surrounded by an upper and lower rigid ring such that light diffusion panels are positioned in the frame and supported by the lower ring. Thus, it is necessary to have a lower projection or tab upon which the panel may rest. Another lampshade with flexible light diffusion panels are detachably connected to a frame described in U.S. Pat. No. 2,683,800. This panel shows the panel members being secured to the frame by slots in the panel members thereby necessitating the need for cutting of the slots in each panel member to insure proper fit.

The present invention alleviates the need for expensive cuts or mounting recesses by providing a pair of arcuate or cylindrically or other shaped vertical support members joined together along a peripheral portion whereby each frame joint forms a concave recessed portion that allows a flexible panel edge to be disposed therein at a variety of angles under tension. This allows the flexible panels to be arranged in a particular shape depending on the disposition and relative positioning of adjacent vertical frame members. In an alternate embodiment, a connector is provided that is flexible that has a pair of opposingly joined arcuate walls connected together by a flat member that is received through a slot in a conduit. The resiliency of the connector allows for the insertion between the vertical support and one of the connector arcuate walls to allow for variable angles between the panel and the frame member itself.

BRIEF DESCRIPTION OF THE INVENTION

A lampshade having a plurality of rigid vertical frame members, each of said frame members having first and second arcuate shaped support members, said first and second support members joined together along a line forming concave surfaces on either side of the support member. The vertical frame members may be disposed in multiple arrays of three or more parallel frame members which include additional joining frame support members to a central radial position along the top an bottom.

A plurality of flexible light diffusing panels are inserted along each vertical edge into the concave recess formed by the first and second vertical support members. The panels may be disposed between adjacent frame members under tension in a variety of contours depending on the distance and size and width of the panel in conjunction with the spacing between adjacent vertical support members.

In an alternate embodiment, a single vertical support conduit is employed in conjunction with an elongated flexible fastener, the fastener having a pair of arcuate shaped resilient walls opposedly disposed connected by a central straight wall running the length of the connector. The connector is received into a slot disposed longitudinally along the vertical support member such that one of the walls is disposed on the inside of the support member or frame member while the other arcuate wall is disposed on the outside. Additionally, an oval shaped rod is disposed within the vertical frame tube such that the rod has a lever, movable from a first to a second position which moves the cross-sectional diameter of the rod (which is oval) to allow contact between the rod and the inside arcuate wall of the flexible connector which allows a compression force to be disposed on the connector to allow insertion of the panel edge to insure a tight fit of the panel. The outside arcuate wall of the flexible connector in conjunction with the rigid wall of the vertical frame tube allows panels to be inserted and held firmly in place between the frame vertical member and the outside arcuate wall such that various angular relationships between the panel and the frame may be established to allow for a variety of ultimate lampshade shapes.

The panels are translucent such that illumination of a light bulb from a lamp within provides for shaded, tinted or diffused light patterns outside of the lampshade. The shades may be made in any desired vertical length. The vertical frame members supporting the shade may be likewise used and continued on to provide a base or stand for the lamp itself or the lampshade may be used in conjunction with a standard lamp base and supported across the top portion in a conventional manner.

It is an object of this invention to provide an improved lampshade that allows for the creation of a variety of panel members for particular light diffusion and a variety of various shaped lampshades while utilizing a minimal number of standard components.

It is another object of this invention to provide an improved lampshade that is readily constructed and noncomplex in construction costs or structural components utilized therein.

In accordance with these and other objects which will be apparent hereinafter, the instant invention will now be described with particular reference to the accompanying drawings.

BRIEF DESCRIPTION OF THE DRAWINGS

FIG. 1 shows a perspective view of a lampshade made in accordance with the instant invention illustrating convex shade pieces, a straight shade piece, and a concave shade piece.

FIG. 2 shows a top plan view of the embodiment of the instant invention shown in FIG. 1 with all convex pieces.

FIG. 3 shows a top plan view partially in cross-section of a fastener of the instant invention in a frame member.

FIG. 4 shows a top plan view partially in cross-section just before the fastener connects the shade to the frame.

FIG. 5 shows a perspective view of a flexible connector used in the alternate embodiment of the instant invention.

FIG. 6 shows another embodiment of the fastener.

PREFERRED EMBODIMENT OF THE INVENTION

Referring now to the drawings and especially FIG. 1, a partially constructed lampshade in accordance with the instant invention is shown generally at 10 comprised of a plurality of rigid vertical frame members 12 including members 12', 12'', 12''', and 12$^{iv}$ having for example, at each position a first cylindrical rigid tube **12*a* and a second cylindrical rigid member 12*b* connected together along one peripheral edge such that they form generally V-shaped recesses on each side of the frame member. The frame members 12*a* may be continued radially inward along the top to a central radial axis of the shade. In the example shown, four rigid vertical members are utilized. However, any number greater than three might be equally disposed to accomplish the instant invention. The vertical frame members may have other cross-sectional shapes such as oval, polygonal, etc. Flexible light diffusing panels 14 are tensionally coupled between adjacent frame members 12 by the generally V-shaped recesses. In the example as shown, the panels 14 are sized larger in width to provide a circular or arcuate shape. The bending forces aid in holding the panels 14 in place and allow easy removal of the panels 14**.

FIG. 2 shows a panel 14 connected between adjacent frame members 12' and 12'' such that the outside circular member 12 is joined to the inside circular member **12*b* allowing the vertical edge of the panel to fit comfortably in a concave recess formed on each side. Other panels in smaller width could be inserted to form a flat shade 13. Concave panels 17 may also be used. A plurality of thin shade members of different colors may be used over one another as shown at 17 and 17'**.

FIG. 3 shows an alternate embodiment of the instant invention in which a rigid vertical tube frame member 18 is utilized in conjunction with a flexible connector 20 and a rigid oval-shaped cam 22 having a lever 26 affixed. The flexible connector 20 shown in FIGS. 3, 4, and 5 is disposed in a slot in the rigid vertical frame member 18 such that it has a pair of arcuate walls **20*a* and 20*c* with arcuate wall 20*c* being disposed inside of the tube and having a more circular shape than the exterior arcuate wall 20*a*. Walls 20*a* and 20*c* are connected by wall 20*b*. Member 18** may be a square conduit.

In FIG. 4, flexible panels 24 and 24' with vertical edges 25 and 25' are inserted between the periphery of the rigid vertical tube 18 and the inner wall portion of the exterior arcuate wall **20*a* of the flexible connector. The vertical edges 25 and 25' are in contact with a central planar wall portion 20*b* of the flexible connector 20. The rigid oval shaped cam 22 is moved from the position as shown in FIG. 3 with the narrower diameter aligned with the central straight wall 20*b* of the flexible connector 20 to the position as shown in FIG. 4 to allow insertion of the flexible panels. To insert a panel, the oval-shaped cam 22 is rotated by lever 26 ninety degrees to its longer diameter to force the flexible connector 20 by bending the resilient arcuate wall 20*c* to provide an opening to insert panels 24 and 24' between the outer periphery of rigid vertical support member 18 and the outer arcuate wall 20*a*. Once each panel is inserted on each side, the rigid oval shaped cam 22 is then rotated back to its normal original position as shown in FIG. 3 with the panels being kept in place under for force from the flexible connector arcuate wall 20*c***.

Using the flexible connector 20, which may be of any length as shown in FIG. 5, the panel angle formed between the outside arcuate wall **20*a* of the flexible connector which is wall 20*a*** may be disposed at a variety of angles to allow for the overall shaping of the lampshade as desired.

In FIG. 6, the connector may use a rigid member 30 with walls 31, 32, and 33. Resilient members 34 and 35 may be used as a clamping biasing means.

Using the embodiments of the invention, a plethora of various overall shaped lampshades having various diffusing panels disposed circularly and inwardly outwardly can be achieved using standardized frame and connector members as shown.

It should be noted that two or more panels may be used in place of each of the single panel shown in the drawing. Such panels may be thinner and may be used to create various designs and color patterns.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A lampshade device having a plurality of removable light diffusing panels comprising:

at least three rigid vertically disposed frame members, each of said frame members including a first rigid vertical support means having an arcuate wall portion and a second support means connected to said first member having a wall portion, said members connected together so that the adjacent wall portions provide a lampshade panel recess;

a means for rigidly connecting said vertical frame members together; and a plurality of flexible light diffusing lampshade panels including side edges, each of said panels tensionally connected between adjacent frame members, said side edges of said panels connected in said recess formed by said frame member and said support means, said first frame member is a rigid tubular frame member having a slot disposed along a longitudinal portion, said support means is a plurality of flexible connectors, each flexible connector having first and second arcuate walls connected by a generally straight wall positioned so that said first arcuate wall provides gripping jaws in relation to the outside surface of said frame member, and said second arcuate wall being positioned on the inside of said frame member.

2. A lampshade device having a plurality of removable light diffusing panels comprising:

at least three rigid vertically disposed frame members, each of said frame member including a first rigid vertical support means having an arcuate wall portion and a second support means connected to said first member having a wall portion, said members connected together so that the adjacent wall portions provide a lampshade panel recess;

a means for rigidly connecting said vertical frame members together; and a plurality of flexible light diffusing lampshade panels including side edges, each of said panels tensionally connected between adjacent frame members, said side edges of said panels connected in said recess formed by said frame member and said support means, said first frame member is a rigid tubular frame member having a slot disposed along a portion longitudinally;

said support means is a plurality of flexible connectors, each flexible connector having first and second arcuate walls connected by a generally straight wall positioned so that said first arcuate wall provides gripping jaws in relation to the outside surface of said frame member, and said second arcuate wall being positioned on the inside of said frame member and contoured to bias said first arcuate wall against the outside surface of said frame member;

a means connected to said first frame member and said flexible connector to move said first arcuate wall away from the outside surface of said frame member.

3. A lampshade device as in claim 2, wherein said means connected to said first frame member and said flexible connector includes:

a cam and lever.

* * * * *